US010881914B2

(12) United States Patent
Hamburger

(10) Patent No.: US 10,881,914 B2
(45) Date of Patent: Jan. 5, 2021

(54) ADJUSTABLE GOLF CLUB WITH SELECTABLE HOSEL

(71) Applicant: Edward Hamburger, Toms River, NJ (US)

(72) Inventor: Edward Hamburger, Toms River, NJ (US)

( * ) Notice: Subject to any disclaimer, the term of this patent is extended or adjusted under 35 U.S.C. 154(b) by 0 days.

(21) Appl. No.: 16/809,956

(22) Filed: Mar. 5, 2020

(65) Prior Publication Data

US 2020/0282267 A1 Sep. 10, 2020

Related U.S. Application Data

(60) Provisional application No. 62/813,965, filed on Mar. 5, 2019.

(51) Int. Cl.
*A63B 53/06* (2015.01)
*A63B 53/02* (2015.01)
*A63B 53/00* (2015.01)

(52) U.S. Cl.
CPC ..... *A63B 53/02* (2013.01); *A63B 53/007* (2013.01); *A63B 53/023* (2020.08)

(58) Field of Classification Search
CPC . A63B 53/02; A63B 53/007; A63B 2053/023; A63B 2053/22; A63B 2053/24; A63B 2053/025; A63B 2053/26; A63B 2053/027
See application file for complete search history.

(56) References Cited

U.S. PATENT DOCUMENTS

| | | | | |
|---|---|---|---|---|
| 4,943,059 | A * | 7/1990 | Morell | A63B 53/02 473/306 |
| 5,513,844 | A | 5/1996 | Ashcraft et al. | |
| 5,538,245 | A | 7/1996 | Moore | |
| 5,863,257 | A | 1/1999 | Busnardo | |
| 6,213,889 | B1 * | 4/2001 | Hamburger | A63B 60/00 473/245 |
| 6,287,215 | B1 | 9/2001 | Fisher | |
| 6,475,100 | B1 | 11/2002 | Helmstetter et al. | |
| 6,569,029 | B1 | 5/2003 | Hamburger | |
| 6,623,372 | B1 * | 9/2003 | Beebe | A63B 53/02 473/231 |
| 6,641,487 | B1 | 11/2003 | Hamburger | |
| 6,692,371 | B2 * | 2/2004 | Berish | A63B 53/02 473/244 |
| 7,059,970 | B1 | 6/2006 | Hamburger | |
| 7,077,760 | B2 * | 7/2006 | Gray | A63B 53/02 473/313 |
| 7,846,037 | B2 | 12/2010 | Burnett et al. | |

(Continued)

OTHER PUBLICATIONS

USGA Equipment Rules, Jan. 1, 2019.
USGA Interpretations of Equipment Rule 1, https://www.usga.org/equipment-standards/equipment-rules-2019/equipment-rules/part-2-rule-1-interpretations.html.

*Primary Examiner* — Stephen L Blau
(74) *Attorney, Agent, or Firm* — MacMillan, Sobanski & Todd, LLC

(57) ABSTRACT

An improved golf club putter having a selectable hosel, each hosel having a characteristic lie angle and loft angle, wherein the hosel is mounted to the head of the golf club, and wherein the hosel has a position orientation feature which aligns the shaft and hand grip with respect to the putter head for accurate operation of the golf club putter.

16 Claims, 8 Drawing Sheets

(56) References Cited

U.S. PATENT DOCUMENTS

| | | | | |
|---|---|---|---|---|
| 7,931,542 | B2 * | 4/2011 | Kusumoto | A63B 53/02 473/288 |
| 7,963,855 | B2 | 6/2011 | Sander et al. | |
| 8,096,894 | B2 | 1/2012 | Sander | |
| 8,727,905 | B2 | 5/2014 | Murphy et al. | |
| 8,758,153 | B2 | 6/2014 | Sargent et al. | |
| 8,876,622 | B2 * | 11/2014 | Beach | A63B 53/06 473/244 |
| 8,939,847 | B2 | 1/2015 | Sander et al. | |
| 9,981,170 | B2 * | 5/2018 | Myers | A63B 53/0487 |
| 10,328,317 | B2 * | 6/2019 | Wang | A63B 53/0487 |
| 2002/0010033 | A1 * | 1/2002 | Aoki | A63B 53/065 473/219 |
| 2006/0293116 | A1 | 12/2006 | Hocknell et al. | |
| 2008/0153621 | A1 * | 6/2008 | Rollinson | A63B 53/02 473/313 |
| 2010/0197423 | A1 | 8/2010 | Thomas et al. | |
| 2011/0111881 | A1 | 5/2011 | Sander et al. | |
| 2012/0034994 | A1 | 2/2012 | Knutson et al. | |
| 2012/0122601 | A1 | 5/2012 | Beach et al. | |
| 2013/0059676 | A1 * | 3/2013 | Boyd | A63B 60/22 473/307 |
| 2015/0080143 | A1 | 3/2015 | Sanyal et al. | |
| 2015/0265884 | A1 * | 9/2015 | Yeh | A63B 53/02 473/314 |
| 2019/0091523 | A1 * | 3/2019 | Li | A63B 53/02 |

* cited by examiner

ADJUSTABLE GOLF CLUB WITH SELECTABLE HOSEL

CROSS-REFERENCE TO RELATED APPLICATIONS

This application claims the benefit of U.S. Provisional Application No. 62/813,965, filed Mar. 5, 2019, the disclosure of which is incorporated herein by reference in its entirety.

BACKGROUND

Golf clubs and putters generally include a shaft, a hand grip attached to one end of the shaft, and a head, such as for example a "wood" or driver head, an iron head, a hybrid iron head, a wedge, or a putter head attached to the other end of the shaft. Commonly, hand grips include formations, such as a flattened area or marking, to indicate proper positioning of a player's hands on the hand grip. The formations of the hand grip should be positioned correctly with respect to a ball contact face of the head to orient the force of the club head relative to the ball for accurate operation of the golf club. However, because of the interaction of club head factors—type of club, weight and weight distribution, and shaft construction and stiffness—affecting the location of club force to the ball along with different field conditions prevailing at different courses a player must adjust his/her swing, grip position and stance to adjust for these factors. While these factors affect every club head type, putter heads can be more sensitive because of the influence of the putting green surface, the lower forces applied to the ball, and the accuracy needed to hit the ball into the cup.

In most golf club putters, the putter head is permanently attached to the shaft so that the axis of the shaft is at a predetermined lie angle. The lie angle is generally defined as the angle between the axis of the shaft and a plane defined by a bottom surface of the putter head in a direction towards or away from the player holding the golf club putter. Also, because the putter head is permanently attached to the shaft, the striking surface of the putter head is at a fixed loft angle. The loft angle is generally defined as the angle between the striking surface and the axis of the shaft. However, due to the above-mentioned factors influencing a particular swing and stance, it would be desirable to adjust the orientation of the head of the putter relative to the shaft so that a more consistent player swing characteristic can be used during play.

Therefore, there is a need for a golf club that allows a player to adjust club head to shaft characteristics, such as the lie angle, and/or the loft angle of a golf club putter. It would also be desirable to select between different shaft lengths, shaft materials and/or grip configurations for a given head configuration to help adjust for prevailing play and player conditions.

SUMMARY

In one aspect of the invention, a golf club comprises a shaft, a head and a hosel. The shaft includes a shaft interface and a shaft positioning datum adjacent to an end of the shaft. The head comprises a head section and a head extension extending from the head section, where the head extension includes at least one head locating datum. The hosel comprises a shaft mount and a hosel extension extending from the shaft mount. The shaft mount has a first shaft mount end and a second shaft mount end. The first end of the shaft mount has a first bore that is adapted to receive the end of the shaft. The shaft mount includes a shaft positioning datum configured to mate with the shaft datum. The hosel extension includes at least one hosel locating datum configured to mate with the at least one head locating datum.

The head extension includes at least one head opening and at least one hosel opening. The at least one head opening is configured to cooperate with the at least one hosel opening. In one embodiment, the hosel extension is a stem extending from the shaft mount and defines a hosel extension interface. The head extension defines a head extension interface such that securing the hosel extension interface to the head extension interface aligns the grip with the striking face. The hosel extension interface includes at least one hosel locating datum and the head extension includes at least one complementary one head locating datum that mate with each other to align the grip with the striking face. In certain embodiments, the head locating datum and the complementary hosel locating datum are configured as protruding pins, dowels, prongs, nibs, or mating conical projections and one of complementary shaped receiving recesses The hosel defines at least one of a loft angle or a lie angle. In certain embodiments, the hosel is part of a kit of selectable hosels covering a range of loft and lie angles where each hosel defines a compound angle representing a loft angle and a lie angle.

In certain embodiments, the shaft receiving chamber of the hosel is formed generally concentric within the shaft mount and the orientation of the shaft mount to the hosel extension defines the at least one loft angle or the lie angle. In other embodiments, the shaft receiving chamber is formed at an angle within the shaft mount relative to the hosel extension to define the loft angle or the lie angle.

The hosel, through the shaft locating datum, and the shaft positioning datum provide orientation of the grip to the striking face of the head. In certain embodiments, the shaft datum and the complementary shaft positioning datum are one of a "D-flat" boss and complementary D-flat relief, at least one pin and at least one complementary detent, or a tapered pin and complementary tapered datum bore.

The golf club head can be any type of head design, but in one embodiment the head is a putter head. The putter head can be configured a blade, a mallet, or a perimeter weighted putter head. In addition to changing between different head configurations, the shaft assembly and tubular section can be varied. The shaft may include a tubular section attached to the shaft interface. The tubular section may be a steel tubular section, an aluminum tubular section, a composite tubular section, a graphite tubular section, or a fiberglass tubular section.

The hosels, each configured with a loft and lie angle, may be a plurality of hosels each defining combinations of the loft angle from a range of loft angles and the lie angle from a range of lie angles. The hosel is selectable from the plurality of hosels to provide the loft and lie angle and may be supplied as a kit of selectable hosels, with or without a range of putter heads.

In certain embodiments, an adjustable putter set includes a putter head, a shaft and a plurality of hosels. The putter head has a putter head section with a striking face and a head extension extending from the head section. The shaft includes a grip, a shaft interface, and a shaft datum. Each of the plurality of hosels has a shaft mount and a hosel extension, the shaft mount including a shaft positioning datum and a shaft receiving chamber, the shaft receiving chamber configured to removably receive the shaft interface and wherein the shaft positioning datum is complementary to the shaft datum such that the grip is aligned with the striking face when the shaft interface is secured to the shaft receiving chamber, the plurality of hosels each defining combinations of the loft angle from a range of loft angles and the lie angle from a range of lie angles, and the hosel is selectable from the plurality of hosels to provide the loft and lie angle. The adjustable putter set shaft includes a tubular section attached to the shaft interface. The putter head section of the set may be configured as one of a blade, a mallet, or a perimeter weighted head section.

Various aspects of this disclosure will become apparent to those skilled in the art from the following detailed description of the preferred embodiment, when read in light of the accompanying drawings.

DETAILED DESCRIPTION

Figure 1:
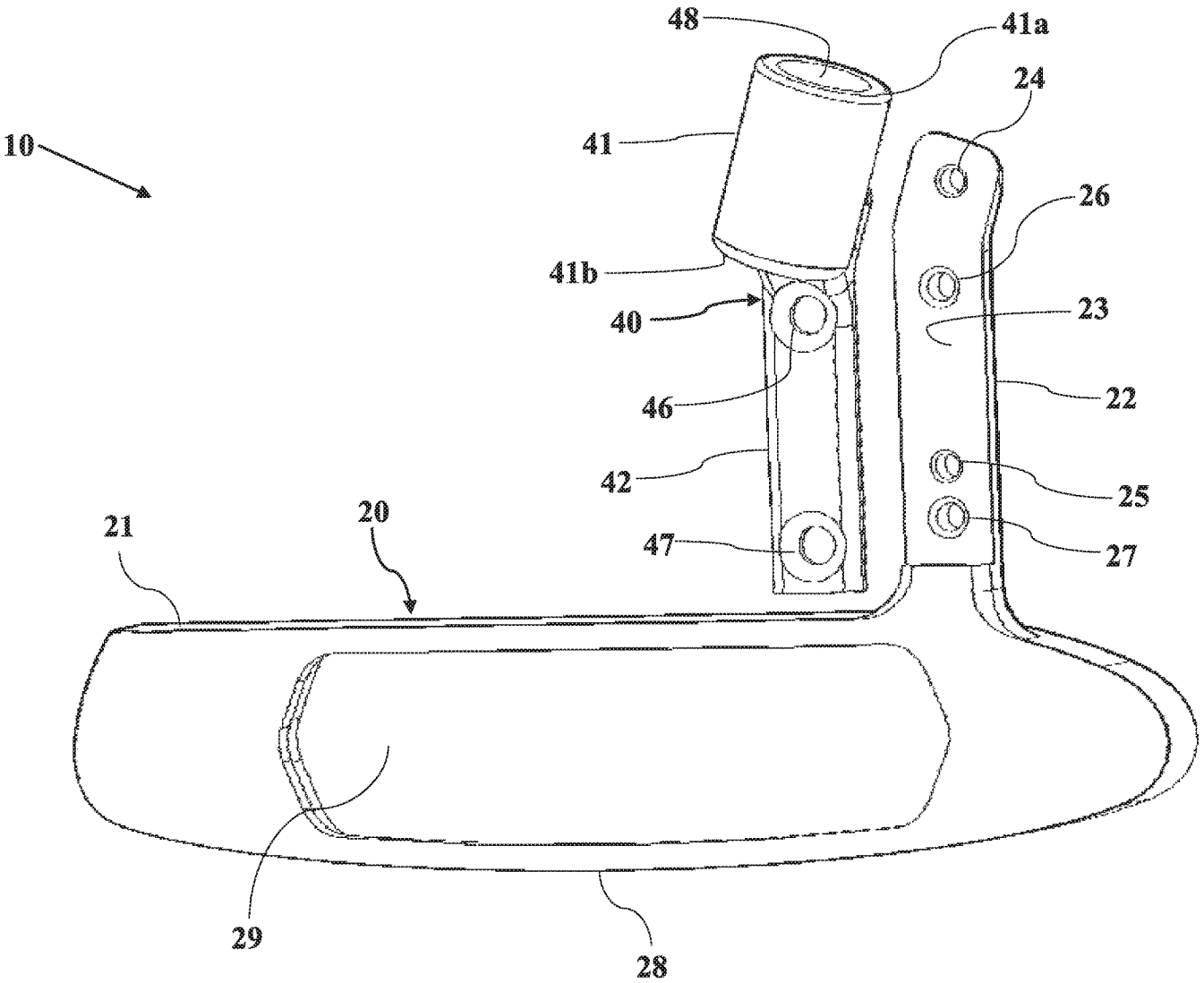
FIG. 1 is a perspective view of a golf club, illustrated as a putter, with selectable hosel in accordance with the present disclosure.
Figure 2:
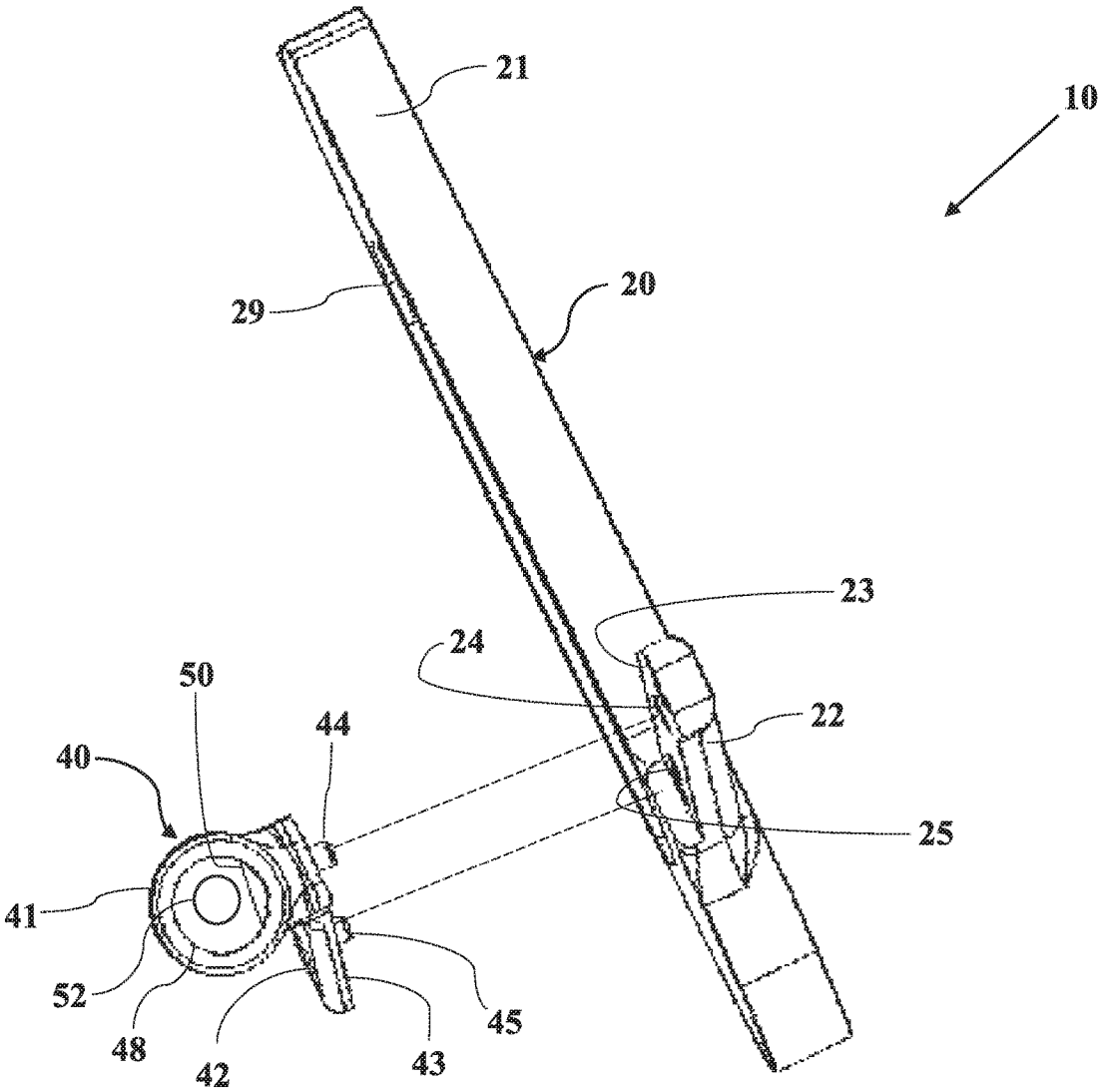
FIG. 2 is a top perspective view of the golf club shown in FIG. 1.
Figure 3A:
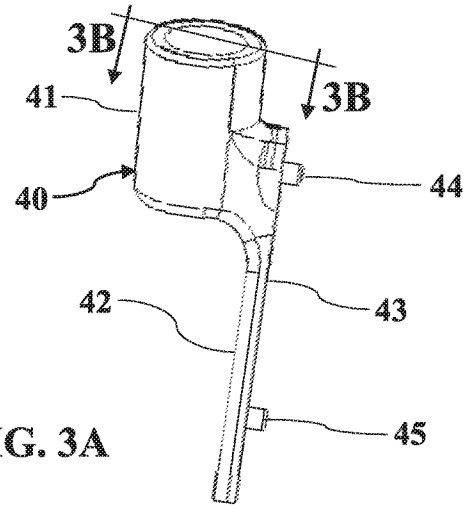
FIG. 3A is a perspective view of a hosel according to an embodiment of the invention.
Figure 3B:
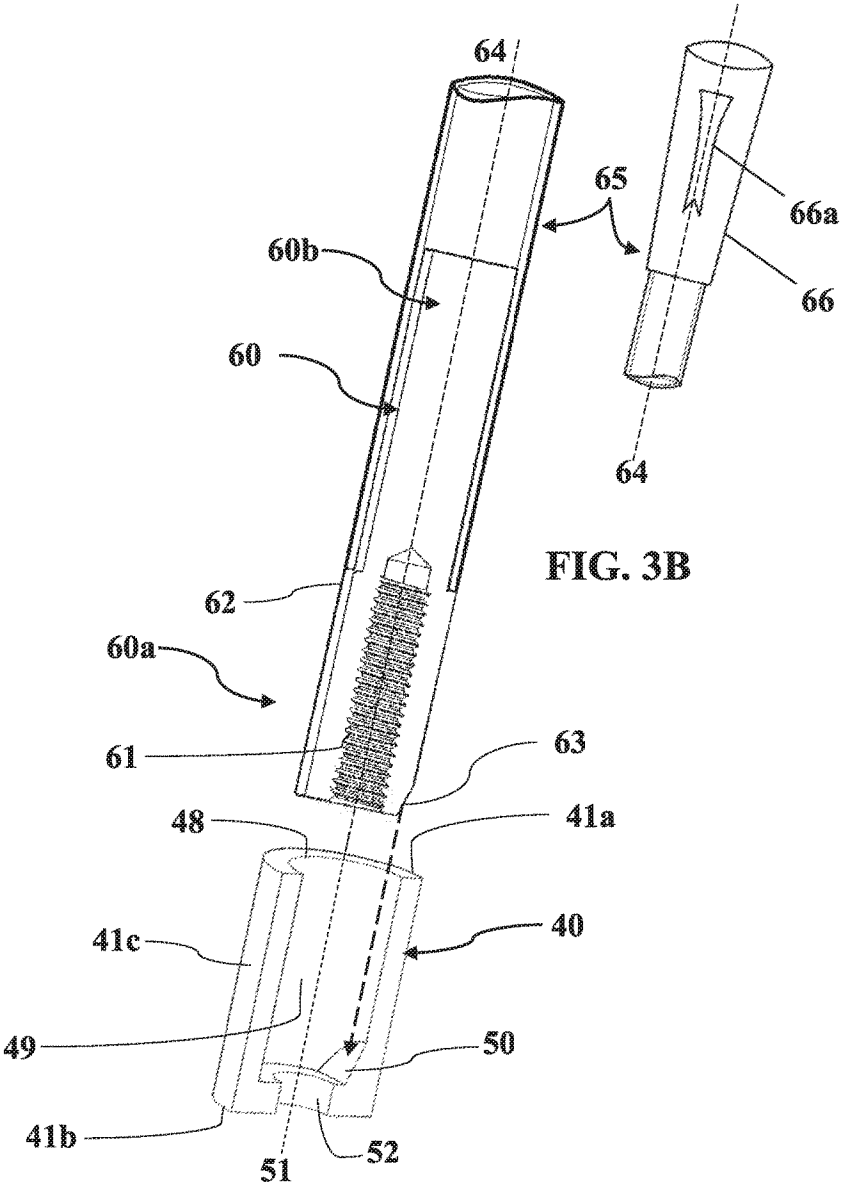
FIG. 3B is a cross sectional, perspective view of the hosel of FIG. 3A, taken along line 3B-3B, a shaft adapter, a club shaft and a grip having a shaft positioning feature.

Referring now to the drawings, there is illustrated in FIGS. 1-3B an embodiment of a golf club, indicated generally at 10, in accordance with the invention. The golf club 10 includes a head 20, a hosel 40, and a shaft adapter 60. Though shown and described in the context of a putter, the invention described herein may be suitable for any type of golf club such as, for example, a driver, an iron, a wedge, or hybrid club. In one embodiment, the shaft adapter 60 of FIG. 3B is removably attached to the hosel 40, and the hosel is removably attached to the head 20. The shaft adapter 60 is fixed to a shaft assembly 65, as shown in FIG. 3B and as will be described below.

The head 20 includes a head section 21 and a head extension 22 extending generally upward from an end of the head section 21. The head section 21 has a bottom surface 28 which can have any suitable shape such as for example, a generally flat or curved shape. The head section 21 has a striking face 29 for contact with a golf ball. The head section 21 and the striking face 29 may have any desired shape and/or may be a removable component formed from the same or a different material. The head section may be a blade, a mallet, or a perimeter weighted putter design (with adjustable weighting and/or varied material constructions) or may be any type of wedge design (sand, chipping, pitching, and the like).

The head extension 22 includes a head extension interface 23, shown as a generally flat and planar surface, though other shapes may be provided. The head extension interface 23 includes at least one locating datum, such as head locating datums 24 and 25, and at least one opening, shown as two openings 26 and 27 extending through the head extension 22. In the illustrated embodiment, the openings 26 and 27 are threaded to accept a fastener.

Figure 6:
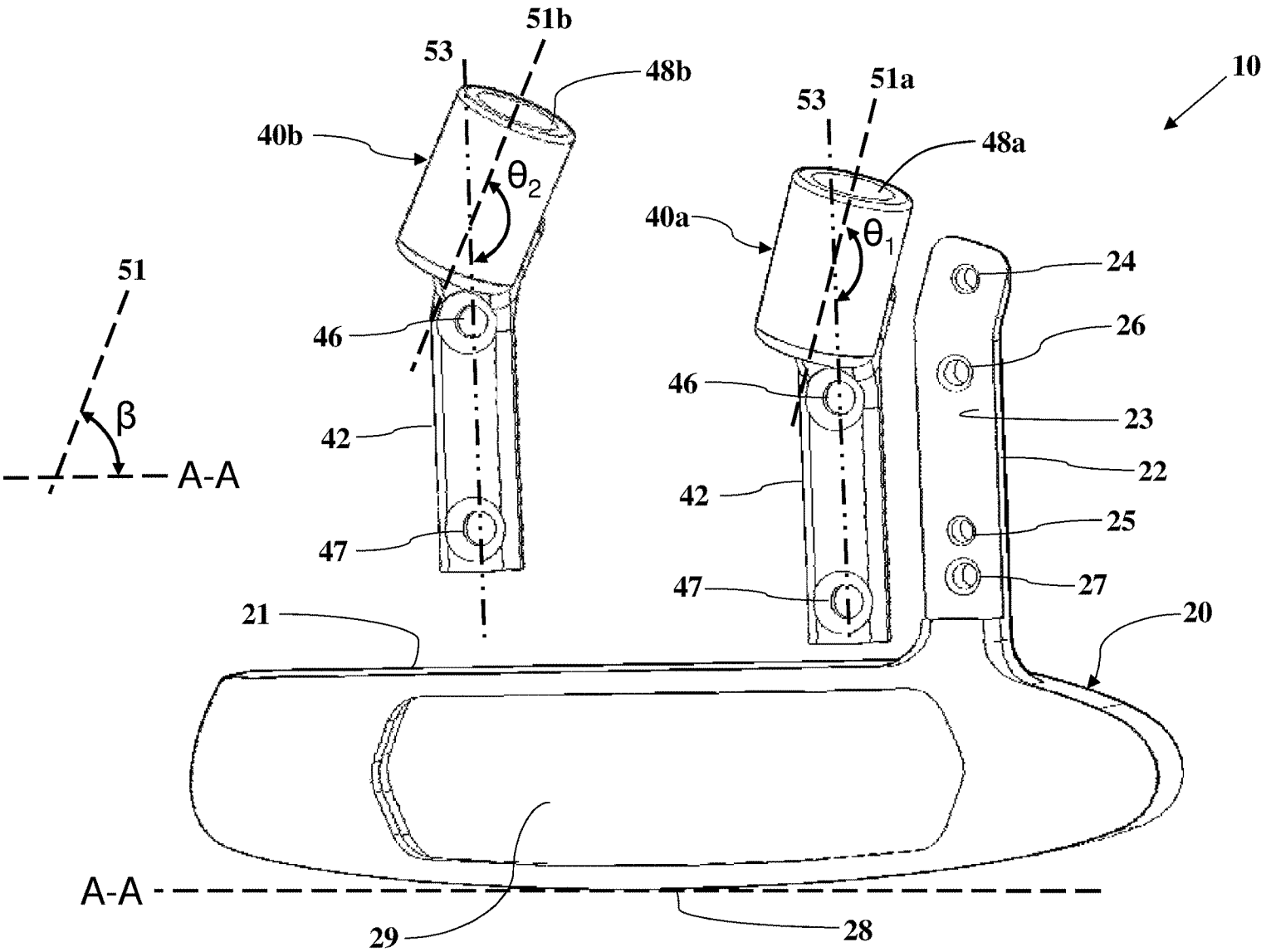
FIG. 6 is a perspective view of a hosel and putter head with the lie angle adjusted by changing the angle of the shaft mount relative to the angle datum.

As illustrated in FIGS. 1 and 6, the head extension interface 23 is a substantially flat surface which includes the first head locating datum 24 and the second head locating datum 25, which are configured to mate with corresponding locating datums 44 and 45 formed on the hosel 40, shown in FIG. 3A. In the embodiments shown in FIGS. 1 and 6, the first head locating datum 24 and the second head locating datum 25 are shown as receiving recesses. However, in other embodiments, the first head locating datum 24 and the second head locating datum 25 may be protruding surface features, such as mating prongs, tabs, nibs, dowels, or similarly functioning projections or some combination of protruding and receiving features. Each head locating datum 24 and 25 is configured to mate with corresponding and complementary locating datums 44 and 45 on the hosel 40. The locating datums 24/25 and 44/45 may have any suitable shape or geometry, such as square, trapezoidal, rectangular, cylindrical, conical, or may be a separate component received within corresponding recesses, such as a dowel rod section, keyway, Woodruff key, and the like. The head extension interface 23 may have any number of locating datums.

As illustrated in FIGS. 1 and 6, the head extension interface 23 is a substantially flat, planar surface which includes attachment bores, illustrated as a first head opening 26 and a second head opening 27. The openings may be blind holes or extend through the head extension interface 23. The first head opening 26 and the second head opening 27 are threaded to accept a fastener for securing these components together and configured to cooperate with corresponding openings 46 and 47 of the hosel 40. The head extension interface 23 may have any number of openings to attach the hosel 40 to the head 20.

As shown in FIGS. 1 and 6, the hosel 40 includes a shaft mount 41 and a hosel extension 42 extending from the shaft mount 41. The shaft mount 41 is illustrated as being formed integrally with the hosel extension 42. The hosel extension 42 includes a hosel extension interface 43, as shown in FIG. 3A, configured to mate with the head extension interface 23 when the hosel 40 is attached to the head 20. The hosel extension interface 43 serves as a reference plane, or interface datum 53, for determining a loft angle $\alpha$, shown in FIGS. 4B and 5B, and a lie angle $\beta$, shown in FIGS. 6 and 7, of the putter 10. In order to repeatedly and accurately attach the hosel 40 to the putter head 10, and for attaching other angularly oriented hosels to the putter head as part of a kit, the hosel extension interface 43 is configured to provide a repeatable, relative orientation of the hosel 40 with respect to the head extension interface 23.

The hosel extension interface 43 contains at least one locating datum, illustrated as spaced-apart locating datums 44 and 45, and at least one opening, illustrated as openings 46 and 47 extending through the hosel extension 42. As shown in FIGS. 3A and 4A-5B, the hosel extension interface 43 is a substantially flat surface which includes the first hosel locating datum 44 and second hosel locating datum 45. The first and second hosel locating datums 44 and 45 are configured to mate with the corresponding first head locating datum 24 and the second head locating datum 25. In the embodiments shown in FIGS. 4A-B and 5A-B, the first hosel locating datum 44 and the second hosel locating datum 45 are protruding pins, dowels, prongs, nibs, or mating conical projections. However, in other embodiments, the first hosel locating datum 44 and the second hosel locating datum 45 can be recessed surface features, such as receiving recesses, or some combination of protruding and receiving features, each configured to mate with corresponding locating datum 24 and 25 on the head 20. The hosel extension interface 43 may have any number of locating datums and generally has the same number of locating datum as the head extension interface 23 to form mating pairs. The hosel extension 42 is illustrated having the first and second hosel openings 46 and 47 extending through the hosel extension 42 to accept a fastener. It should be understood that any number of openings may be provided. The first hosel opening 46 and the second hosel opening 47 are configured to align with the corresponding openings 26 and 27 on the head extension 22 for attachment of the hosel to the head.

The hosel 40 is attached to the head 20 by aligning the head locating datums 24 and 25 with the hosel locating datums 44 and 45, as shown in FIG. 2. The mating datums ensure the desired positioning of the hosel 40 and the particular angle orientations provided by it to the striking face 29. The datums also align the openings 26 and 27 with openings 46 and 47. The hosel extension interface 43 of hosel extension 42 seats flat against the head extension interface 23 of the head extension 22. Once the hosel extension interface 43 is mated with the head extension interface 23, the hosel 40 is fixed relative to the head 20. This provides the orientation of the shaft assembly 65, including the club grip 66, to the striking face 29. In the illustrated embodiment, the hosel 40 is secured to the head 20 by fasteners, such as screws, though other suitable clamping mechanisms such as sliding collars, band clamps and the like can be used to fix the two members together.

As illustrated in FIGS. 3A and 3B, the hosel 40 includes a shaft mount 41 having a first end 41*a*, a second end 41*b*, and a shaft mount body 41*c* extending therebetween. The shaft mount 41 has a first bore 48, as shown in FIGS. 1-3B and 6, which is formed therein and open to the first end 41*a*. The first bore 48 forms a shaft receiving chamber 49 in the shaft mount 41 to accept a first end or hosel interface 60*a* of a shaft adapter 60 for mounting and positioning the shaft assembly 65 relative to the hosel 40 and the head 20. The shaft adapter 60 has a second end 60*b* that is configured to attach to the club shaft assembly 65. Alternatively, the shaft adapter 60 may be formed integrally with the shaft assembly 65. The shaft mount 41 has a shaft positioning datum 50 located within the shaft receiving chamber 49. The shaft positioning datum 50 functions to properly and repeatedly orient the shaft adapter 60, along with the shaft assembly 65, grip 66 and a hand grip alignment mark 66*a* relative to the putter head 20. This permits shaft assemblies having different shaft lengths, shaft materials and/or grip configurations to be substituted, with or without changing hosels, while maintaining the orientation of the grip 66 to the striking face of the club head. The shaft positioning datum 50 may be formed integrally with the shaft mount body 41*c* or it may be a separate component, such as an insert placed inside the shaft receiving chamber 49 or fixed to the shaft first end 60*a*. In the illustrated embodiment, the shaft positioning datum 50 is a canted boss or generally flat surface formed on an inner surface of the shaft mount body 41 and extending radially inwards towards a shaft mount axis 51.

The shaft mount 41 has a second bore or shaft securing bore 52, as shown in FIGS. 2 and 3B, which is formed through the second end 41*b* and opens into the shaft receiving chamber 49. The second bore 52 is configured to accept a fastener, such as for example a threaded screw or a nut mating to an extending threaded section of the shaft adapter 60. In one embodiment, the first end 60*a* of the shaft adapter 60 may have a generally constant diameter for a predetermined length that cooperates with the shaft receiving chamber 49 having a similar shape. Alternatively, the first end 60*a* may be tapered to mate with a tapered embodiment of the shaft receiving chamber 49. The first shaft end 60*a* is configured to be inserted into the first bore 48 of the shaft mount 41. As shown in FIG. 3B, the shaft adapter 60 has a shaft bore 61 that is threaded to accept the threaded fastener 70 for securing to the shaft mount 41 of the hosel 40. Alternatively, the shaft bore 61 may be a male threaded section extending from the first end 60*a* to engage the second bore 52.

The first shaft end 60*a* of the shaft adapter 60 has a shaft interface 62 and a shaft datum 63. The shaft interface 62 may form a line-to-line or slip fit or a tapered interface, such as with a non-locking taper, with the shaft receiving chamber 49. The shaft datum 63 is configured to mate with the shaft positioning datum 50 to ensure that the shaft assembly 65, including the hand grip 66 is properly oriented relative to the putter head 20 when the shaft adapter 60 is mounted in the shaft mount 41 and the hosel 40 is fixable attached to the putter head 20. The shaft datum 63 may be any size, shape and configuration that permits proper orientation and secured attachment of the shaft adapter 60 to the putter head 20. As illustrated in FIG. 3B, the shaft datum is a complementary canted relief that contacts the canted boss shape of the shaft positioning datum 50.

In the illustrated embodiment, the shaft datum 63 is a flat surface that is formed as an angled surface extending from the outer diameter of the shaft interface 62 radially inward towards the shaft axis 64 along the first end 60*a* of the shaft adapter 60. When the shaft adapter 60 is inserted into the shaft mount 41 the surface of the shaft datum 63 engages the surface of the shaft positioning datum 50. The shaft datum 63 and the shaft positioning datum 50 cooperate to properly orient the putter grip 66 relative to the striking face 29 of the putter head 20. The cooperation of the shaft datum 63 and the shaft positioning datum 50 also prevents rotational movement of the shaft adapter 60 inside to the shaft mount 41. In one embodiment, the shaft adapter 60 is fixed to the hosel 20 with the fastener 70 inserted into the second bore 52 and engaging the shaft bore 61.

Figure 3E:
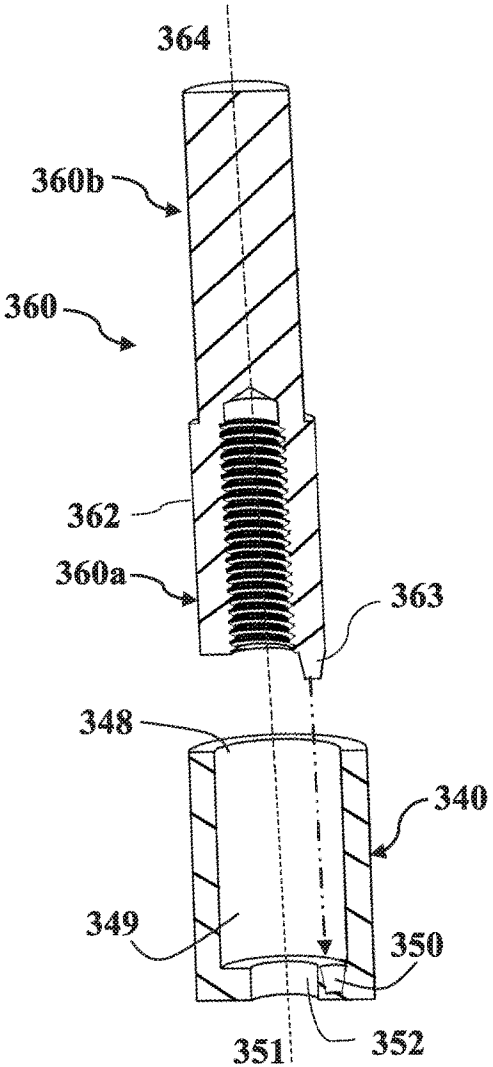
FIG. 3E is a perspective view of yet another embodiment of a hosel and shaft adapter according to the invention.
Figure 3D:
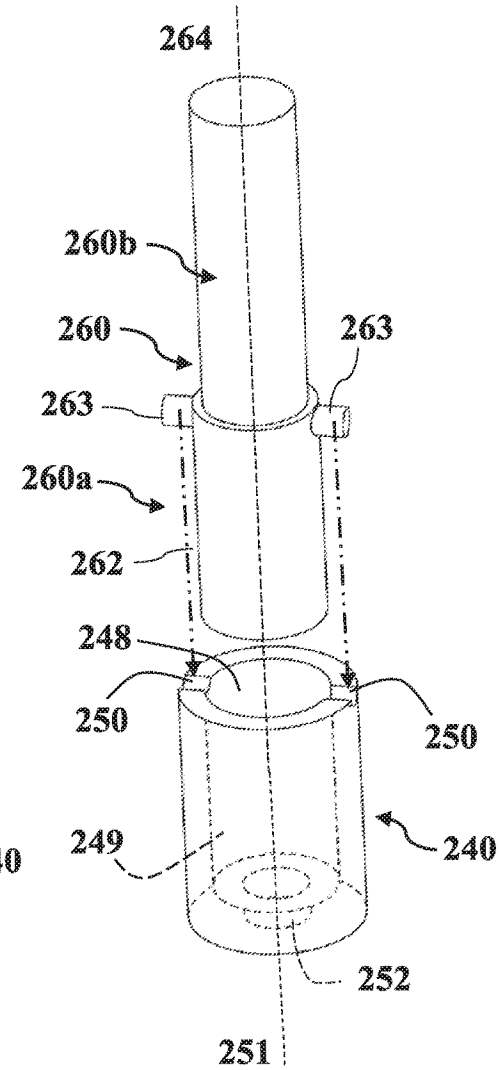
FIG. 3D is a perspective view of yet another embodiment of a hosel and shaft adapter according to the invention.
Figure 3C:
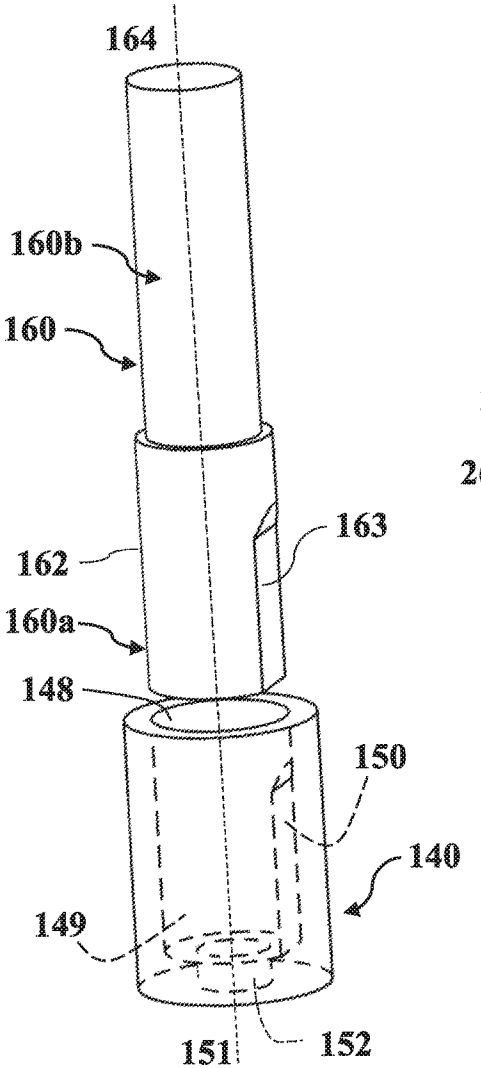
FIG. 3C is a perspective view of another embodiment of a hosel and shaft adapter according to the invention.

As shown in FIGS. 3C, 3D, and 3E, alternative embodiments of hosels (140, 240, 340) and shaft adaptors (160, 260, 360) provide a similar orienting and positioning function of the shaft assembly 65 relative to the head 20. As shown in FIG. 3C, a hosel 140 includes similar features of a first bore 148 defining a shaft receiving chamber 149, a shaft positioning datum 150, a shaft mount axis 151, and a shaft securing bore 152. As illustrated in FIG. 3C, the shaft positioning datum 150 is a generally flat surface formed on a substantial length of an inner surface of the first bore 148 and extending radially inwards towards a shaft mount axis 151. The shaft positioning datum 150 is in the form of a "D-flat" interface (a "D" shaped opening when viewed along axis 151). A mating shaft adaptor 160 includes a first end or hosel interface 160*a* and a second end 160*b*. The hosel interface 160*a* defines a shaft interface 162 and a shaft datum 163 that are complementary to the first bore 148 and the shaft positioning datum 150 of the hosel 140. The second end 160*b* provides an attachment point for the shaft assembly 65.

FIG. 3D depicts a hosel 240 having a first bore 248 defining a shaft receiving chamber 249, a shaft positioning datum illustrated as opposing datum detents 250. The hosel 240 further includes a shaft mount axis 251, and a shaft securing bore 252, similar to the shaft mount axis 51 and shaft securing bore 52. A mating shaft adaptor 260 includes a first end or hosel interface 260*a* and a second end 260*b*. The hosel interface 260*a* defines a shaft interface 262 and a shaft datum illustrated as complementary opposing datum pins 263 that extend from the shaft interface 262. Alternatively the datum pins may extend from the second end 260*b*. The shaft interface 262 locates within the shaft receiving chamber 249. In the illustrated embodiment, the datum pins 263 locate in the datum detents 250 as shown by the arrows in FIG. 3D. The datum pins 263 may be integrally formed with the shaft adaptor 260 or may be a single pin 263 inserted through a bore that extends through the hosel interface 260*a*. Though illustrated as round pins 263 and round detents 250, the pins and detents may be provided in any number and any shape desired.

FIG. 3E depicts a hosel 340 having a first bore 348 that defines a shaft receiving chamber 349, a shaft positioning datum illustrated as a tapered datum bore 350 formed into or extending through the base of the hosel 340. The hosel 340 further includes a shaft mount axis 351, and a shaft securing bore 352, similar to the shaft mount axis 51 and shaft securing bore 52. A mating shaft adaptor 360 includes a first end or hosel interface 360*a* and a second end 360*b*. The second end 360*a* defines a shaft interface 362 that mates with the shaft receiving chamber 349 and a mating shaft datum illustrated as datum pin 363 extending from the end of the second end 360*a*. The datum pin 363 may be integrally formed on the shaft adaptor 360 or may be a separate component attached thereto.

The invention permits a person to change various shaft configurations of a golf club with ease and reliability. Referring again to FIG. 3B, to attach the shaft adapter 60 to the shaft mount 41, the shaft axis 64 is aligned with the shaft mount axis 51. The first shaft end 60*a* is inserted into the shaft receiving chamber 59 along the coincident axes 51/64 so that the surface of the shaft interface 62 engages the inner surfaces of the shaft mount body 41*c* and the surface of the shaft datum 63 engages the surface of the shaft positioning datum 50. Cooperation between the shaft datum 63 and the shaft positioning datum 50 ensures the hand grip is properly oriented relative to the striking face of the putter head 20 when the hosel 40 is attached to the head 20. A fastener is inserted through the second bore 52 and into the shaft bore 61 to secure the shaft adapter 60 in the shaft mount 41. The shaft adapter 60 can be disassembled from the shaft mount 41 by removing of the fastener and withdrawing the shaft adapter 60 from the shaft mount 41.

Figure 7:
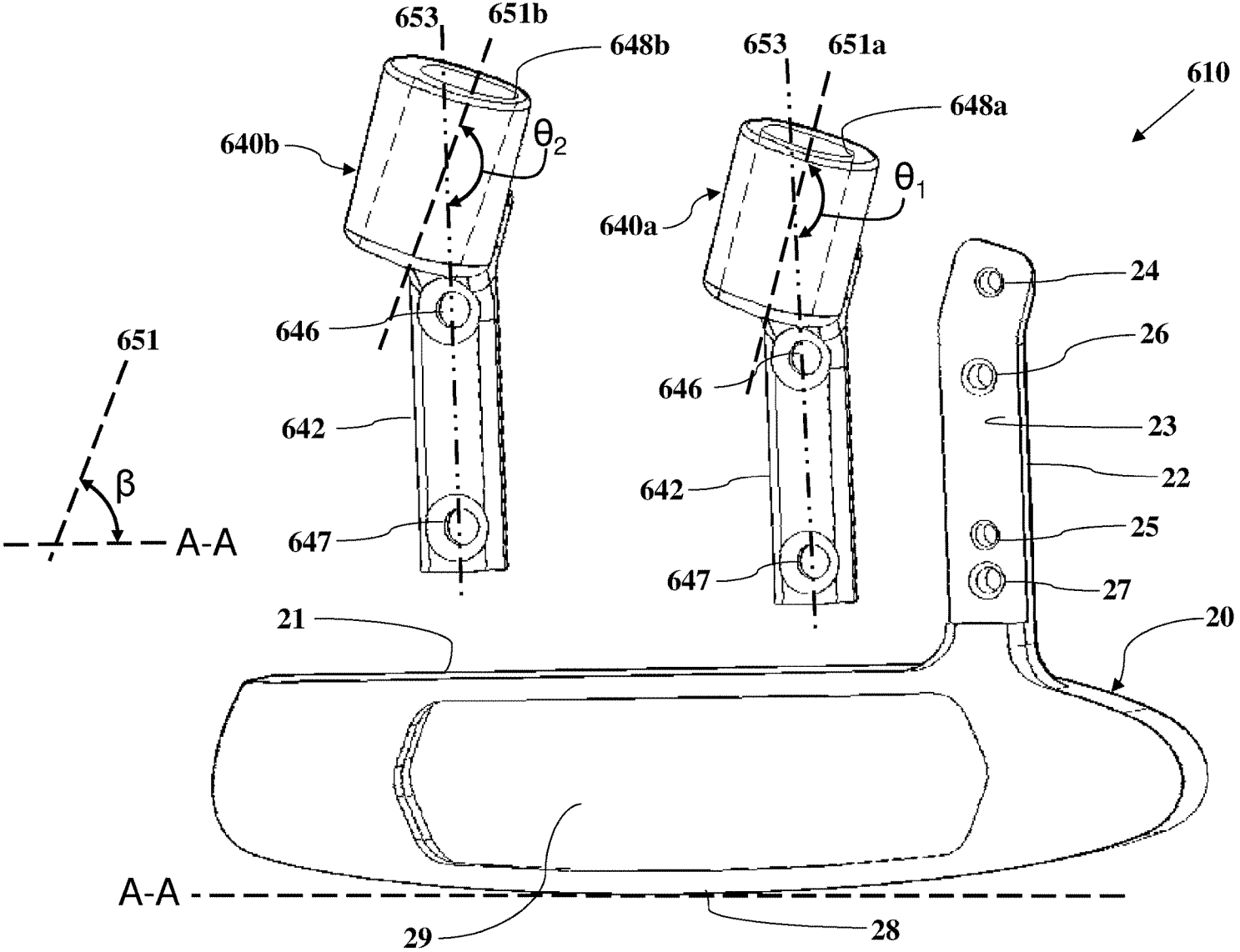
FIG. 7 is a perspective view of a hosel and putter head with the lie angle adjusted by changing the angle of the bore hole and the orientation of the shaft receiving chamber in the shaft mount relative to the angle datum.

The invention also permits a person to change the lie angle β and/or loft angle α of a putter head 20 by selecting a hosel having the desired loft and lie angles from a kit that includes an array of hosels having combinations of desired lie angles β and loft angles α. Referring now to FIGS. 4A and 4B and 5A and 5B, the loft angle α may be generally defined as the angle between the striking surface 29, represented by the striking surface datum 30, and the axis 64 of the shaft assembly 65. As shown in FIGS. 6 and 7, the lie angle β may be generally defined as the angle between the shaft axis 64 or the associated, coaxially oriented shaft mount axis 51 or 651 of the hosel and a plane generally defined by or tangent to the bottom surface 28 of the head section 21 which is represented by line A-A. According to one embodiment, each hosel (40, 140, 240, 340, 440, 540, or 640) is manufactured with a characteristic lie angle β and loft angle α. Therefore, a player may change the lie angle β and/or loft angle α of the putter merely by selecting the hosel with the desired angles and attaching it to the putter head 20 as described above. In assembling the putter 10, the hosel 40 is attached to the putter head 20 and the shaft adapter 60 is mounted in the hosel 40.

Figure 4A:
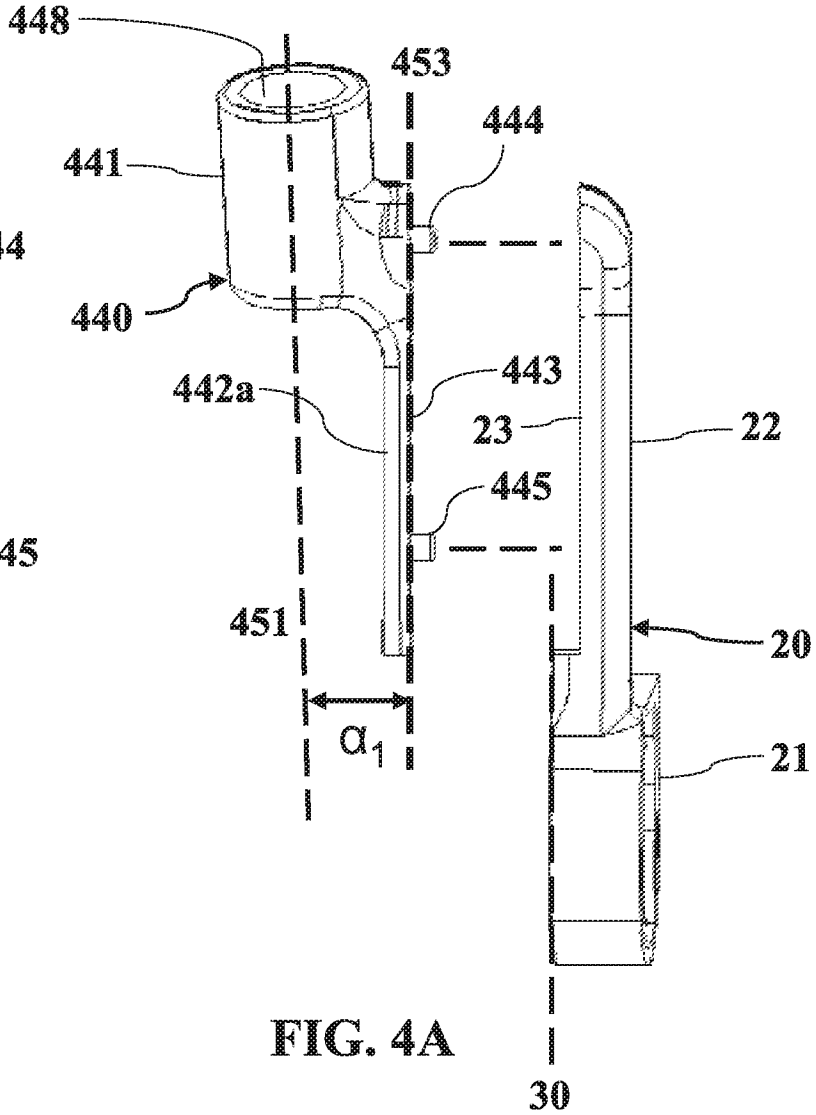
FIG. 4A is a perspective view of a hosel and putter head showing a first loft angle $\alpha$.
Figure 4B:
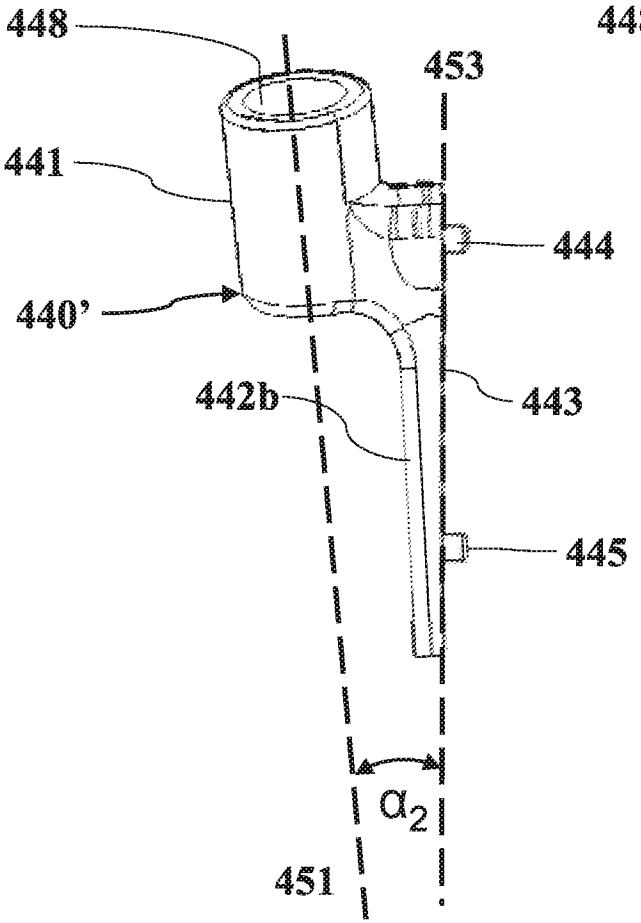
FIG. 4B is a perspective view of a hosel configured to mate with the putter head of FIG. 3A and having a second loft angle $\alpha$ adjusted by changing the formed angle of the shaft mount relative to the angle datum.

Referring now to FIGS. 4A and 4B, a hosel 440 and a hosel 440' are illustrated having different loft angles $\alpha_1$ and $\alpha_2$ formed into stems or hosel extensions 442*a* and 442*b*. The hosel extension 442*a* forms a loft angle $\alpha_1$ between a shaft mount axis 451 and an interface datum 453 of a hosel extension interface 443. In the embodiment of FIGS. 4A and 4B, a bore 448 formed in the shaft mount portion 441 of the hosel 440 and 440' defines a shaft receiving chamber 449 which may be generally centered in the shaft mount 441 in a similar manner regardless of the desired loft angle. As can be seen from a comparison of FIGS. 4A and 4B, the component blank, such as the casting or forging forming the hosels 440 and 440', can accommodate the desired loft angle α by machining a hosel extension interface 443 at the desired loft angle relative to the bore 448. Thus, in this embodiment, the body of the shaft mount 441 has the same general dimensions and the stem 442 accommodates the loft angle. As shown in FIGS. 4A and 4B, the hosel 440 has a lower loft angle $\alpha_1$ than the loft angle $\alpha_2$ of hosel 440'. The head extension interface 23 defines the plane parallel to the striking surface datum 30 of the head section 21. The hosel extension interface 443 mates with the head extension interface 23 to create the loft angle α of the assembled club 10.

Figure 5A:
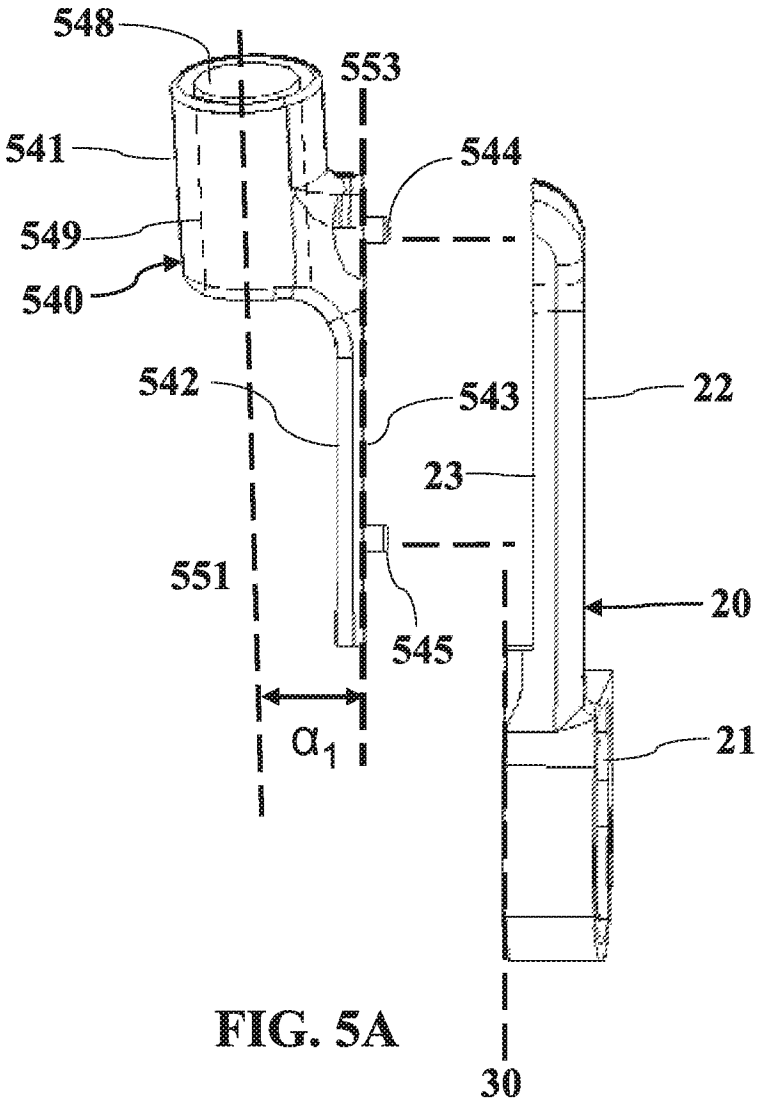
FIG. 5A is a perspective view of a hosel and putter head showing a first loft angle $\alpha$, similar to FIG. 4A.
Figure 5B:
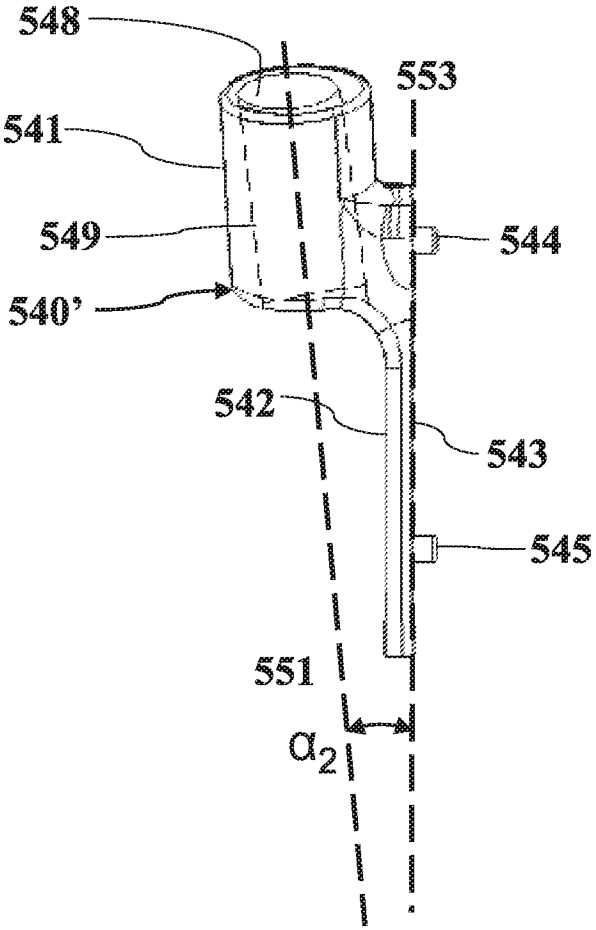
FIG. 5B is a perspective view of a hosel and putter head with a second loft angle $\alpha$ adjusted by changing the angle of the bore hole and the orientation of the shaft receiving chamber in the shaft mount relative to the angle datum.

Referring now to FIGS. 5A and 5B, embodiments of hosels 540 and 540' have bores 548 forming a shaft receiving chamber 549 machined into the shaft mount 541 at the desired loft angle α. In one aspect of the invention, stem or hosel extension 542 may have the same general dimensions regardless of the loft angle. In the illustrated embodiment, bore 548, and an associated shaft mount axis 551, is formed at an angle relative to a hosel extension interface 543. Thus, the component blank forming the shaft mount 541 may be sized to accommodate the range of angles of the bore 548. Alternatively, separate blanks may be designed to form the various hosels.

Referring to FIG. 6, two hosels 40*a* and 40*b* form different lie angles $\beta_1$ and $\beta_2$, respectively, between the shaft mount axis 51 (51*a* or 51*b*) and the interface datum 53. The illustrated hosel 40*a* is similar to the hosel 40 of FIG. 1. The lie angle β can be manipulated by changing the angle θ of the shaft mount axis 51 (51*a* or 51*b*) relative to the interface datum 53. In the illustrated embodiment, the lie angle β is formed by adjusting the angle $\theta_1$ or $\theta_2$ of the shaft mount 40*a* or 40*b*, respectively, and the corresponding bores 48*a* or 48*b*, relative to the hosel extension 42, as shown in FIG. 6. As illustrated, the bores 48*a* or 48*b* are formed in the hosel and are generally positioned to provide a generally uniform wall thickness. Thus, each lie angle is provided by a separate hosel blank.

In an alternative embodiment illustrated in FIG. 7, the lie angle β is varied by adjusting the angle of a first bore 648 (648*a* or 648*b*) within the shaft mount 41. Hosel 640*a* has the bore 648*a* and the associated shaft mount axis 651*a* drilled or otherwise formed at an angle $\theta_1$ relative to an interface axis 653 to establish the lie angle β. Hosel 640*b* has bore 648*b* oriented at an angle $\theta_2$ relative to the interface axis 653 to establish the lie angle β. This embodiment can utilize a single hosel blank for each lie angle β of the various hosels. In yet other embodiments, combinations of bore angle adjustments and hosel blank variations can be mixed to provide a limited number of blanks yet maintain desired wall thicknesses of the shaft receiving chamber 49. Because the hosel extension interface is unchanged between hosels, every hosel properly mates with the head extension interface 23 of the putter head 20, which allows a player to change the lie angle β, and similarly loft angle α by selecting and changing the appropriate hosel. In the embodiment depicted in FIG. 7, the lie angle β formed by angle $\theta_1$ is smaller than the lie angle β formed by angle $\theta_2$.

The embodiments of various hosels with loft or lie angles formed therein can be combined in any desired manner to produce a kit of selectable hosels, each having the desired loft and lie angle formed into a single hosel. For example, the loft angle hosels 440 and 440' of FIGS. 4A and 4B can be combined with the lie angle hosels 640*a* and 640*b* to produce an array of hosels where the bore is formed generally concentric to a wall of the hosel blank and arranged for selection by the lie angle and the loft angle. In one embodiment, the combination of loft and lie angles results in a plurality of different hosel blanks based on the lie angle with the loft angle machined into the hosel stem. In another example, combining the hosels of FIGS. 5A, 5B and FIG. 7 can provide a single blank design that accommodates all loft and lie angles by forming the finished hosel stem and machining the bore at the desired combined loft and lie angles relative to the hosel stem. Thus, a wide array of adjustment can be made to a putter by simply selecting the hosel with the desired loft and lie angles formed therein and attaching the selected hosel to the putter head. In addition, shaft assemblies with different stiffness characteristics can be mounted to the selected hosel.

The principle and mode of operation of this disclosure have been explained and illustrated in its embodiments. However, it must be understood that this disclosure may be practiced otherwise than as specifically explained and illustrated without departing from its spirit or scope.

What is claimed is:

1. A golf club comprising:

a shaft comprising a grip, a shaft interface, and a shaft datum;

a head comprising a head section having a striking face and a head extension extending from the head section, the head extension defining a head extension interface; and a hosel comprising a shaft mount and a hosel extension, the hosel extension having a hosel extension interface configured to be removably secured to the head extension interface, the hosel defining a singular arrangement of a loft and a lie angle established by a permanently-formed relative orientation between the shaft mount and the hosel extension, the shaft mount including a shaft positioning datum and a shaft receiving chamber, the shaft receiving chamber configured to removably receive the shaft interface and wherein the shaft positioning datum is complementary to the shaft datum such that the grip is aligned with the striking face when the shaft interface is secured to the shaft receiving chamber and wherein securing the hosel extension interface to the head extension interface establishes the loft and lie angle between the grip and the striking face.

2. The golf club of claim 1 wherein the hosel extension is configured as a stem extending from the shaft mount and defines the hosel extension interface, the head extension configured as a complementary stem that is removably secured to the head extension interface wherein securing the hosel extension interface to the head extension interface aligns the grip with the striking face.

3. The golf club of claim 2 wherein the hosel extension interface includes at least one hosel locating datum and the head extension includes at least one complementary one head locating datum configured to mate with the at least one hosel locating datum to align the grip with the striking face.

4. The golf club of claim 3 wherein the at least one head locating datum and the complementary hosel locating datum are one of protruding pins, dowels, prongs, nibs, or mating conical projections and one of complementary shaped receiving recesses.

5. The golf club of claim 1 wherein the hosel defines the loft angle and the lie angle.

6. The golf club of claim 1 wherein the shaft receiving chamber is formed generally concentric within the shaft mount and the orientation of the shaft mount to the hosel extension defines the at least one.

7. The golf club of claim 1 wherein the shaft receiving chamber is formed at an angle within the shaft mount relative to the hosel extension to define the loft angle and the lie angle.

8. The golf club head of claim 1 wherein the shaft datum and the complementary shaft positioning datum are one of a "D-flat" boss and complementary D-flat relief, at least one pin and at least one complementary detent, or a tapered pin and complementary tapered datum bore.

9. The golf club of claim 1 wherein the head is a putter head.

10. The golf club of claim 9 wherein the putter head includes a putter head section configured as one of a blade, a mallet, or a perimeter weighted head section.

11. The golf club of claim 10 wherein the hosel is a plurality of hosels each defining combinations of the loft angle from a range of loft angles and the lie angle from a range of lie angles, and the hosel is selectable from the plurality of hosels to provide the loft and lie angle.

12. The golf club of claim 11 wherein the plurality of hosels are arranged with the putter head as a kit.

13. The golf club of claim 9 wherein the shaft includes a tubular section attached to the shaft interface, the tubular section configured as one of a steel tubular section, an aluminum tubular section, a composite tubular section, a graphite tubular section, or a fiberglass tubular section.

14. A golf club comprising:

a shaft comprising a grip, and a shaft interface;

a head comprising a head section having a striking face and a head extension extending from the head section, the head extension defining a head extension interface; and a hosel comprising a shaft mount and a hosel extension, the hosel extension having a hosel extension interface configured to be removably secured to the head extension interface, the hosel defining a singular combination of a loft and a lie angle established by a permanently-formed relative orientation between the shaft mount and the hosel extension, the shaft mount configured to removably receive the shaft interface and wherein securing the hosel extension interface to the head extension interface establishes the singular combination of the loft and lie angle between the grip and the head.

15. The golf club of claim 14 wherein the hosel extension interface includes at least one hosel locating datum and the head extension includes at least one complementary one head locating datum configured to mate with the at least one hosel locating datum to align the grip with the striking face, the hosel extension and the head extension removably secured together with at least one threaded fastener.

16. The golf club of claim 14 wherein the hosel is a plurality of hosels each defining singular combinations of the loft angle from a range of loft angles and the lie angle from a range of lie angles, and the hosel is selectable from the plurality of hosels to provide the singular combination of loft and lie angle.

* * * * *